US005411304A

United States Patent [19]

Muto et al.

[11] Patent Number: 5,411,304

[45] Date of Patent: May 2, 1995

[54] GRAB BUCKET OF ELECTROHYDRAULIC PRESSURE TYPE WITH LIFTING MAGNET

[75] Inventors: Yoshitaka Muto, Fukushima; Tadashi Mine, Yuki, both of Japan

[73] Assignee: Totetsu Koun Co., Ltd., Tokyo, Japan

[21] Appl. No.: 134,832

[22] Filed: Oct. 12, 1993

[30] Foreign Application Priority Data

Oct. 15, 1992 [JP] Japan ..... 4-071951 U

[51] Int. Cl.[6] ..... B66C 1/06; B66C 3/04

[52] U.S. Cl. ..... 294/2; 294/65.5; 294/86.4; 294/88; 294/106; 414/606

[58] Field of Search ..... 294/2, 3, 65.5, 67.31, 294/67.33, 68.23, 86.4, 88, 106, 107, 113, 120; 414/606

[56] References Cited

U.S. PATENT DOCUMENTS

| | | | |
|---|---|---|---|
| 2,850,189 | 9/1958 | Leroy | 414/606 |
| 3,387,718 | 6/1968 | Roth et al. | 294/2 X |
| 3,854,609 | 12/1974 | Cox | 294/107 X |
| 4,355,936 | 10/1982 | Thomas et al. | 294/2 X |
| 4,592,692 | 6/1986 | Suizu et al. | 294/107 X |

FOREIGN PATENT DOCUMENTS

| | | | |
|---|---|---|---|
| 99080 | 1/1925 | Austria | 294/2 |
| 2651220 | 3/1991 | France | 294/2 |
| 290886 | 3/1916 | Germany | 414/606 |
| 62-65488 | 4/1987 | Japan . | |
| 62-79788 | 5/1987 | Japan . | |
| 590239 | 1/1978 | U.S.S.R. | 294/2 |
| 628075 | 10/1978 | U.S.S.R. | 294/2 |

*Primary Examiner*—Johnny D. Cherry
*Attorney, Agent, or Firm*—Longacre & White

[57] ABSTRACT

The grab bucket of the present invention comprises the grabbing claws provided for opening and closing around the main body suspended from a crane, the electromagnet provided movably upward and downward from the ordinary location just underneath the main body to the dredging position on the bed and the side claws provided movably upward and downward to prevent the scrap from overflowing so as to increase the amount of the scrap to be loaded and unloaded. The side claws prevent the side plates and bed surface from being damaged. In the case of dredging the scrap on the bed, only the electromagnet proceeds unloading, thus the bed is not damaged by the grabbing claws.

5 Claims, 3 Drawing Sheets

GRAB BUCKET OF ELECTROHYDRAULIC PRESSURE TYPE WITH LIFTING MAGNET

FIELD OF THE INVENTION

The present invention relates to a grab bucket for loading and unloading materials such as scrapped materials, and particularly to a grab bucket suitable for loading the scrap to and unloading said scrap from the bed of the truck.

BACKGROUND OF THE INVENTION

PRIOR ARTS

As for a grab bucket for loading and unloading the scrapped materials, there have been disclosed some kinds of grab buckets such as a lifting magnet type or claw opening and closing type.

The disc type electromagnet suspended by a crane is excited to attract the scrap. After loading the scrap by the operation of said disc type electromagnet, the electromagnet is excited to separate the scrap. In the grab bucket of the claw type, the upper portion of the semicircular type claw is rotatably supported on the main body suspended from the crane and the claws are opened and closed by means of hydraulic cylinders connected to each of the claws, respectively.

However, in the case of the lifting electromagnet type, the scrap is attracted only in the vicinity of the bottom surface of the electromagnet, thus loading efficiency is not very good because the amount of the scrap to be carried out in each operation is limited. If stoppage of electric current should occur during operation, the scrap unexpectedly falls down.

In the case of a claw opening and closing type grab bucket, it is possible to increase the amount of the scrap to be loaded and unloaded in each time of operation but there have been designated the following demerits.

(1) There is a fear that the scrap is spilled during loading or unloading.

(2) As the claw of semicircular type expands sideways during opening operation of the claw, it is not possible to perfectly unload the scrap on the corner of the bed of the truck.

(3) When dredging the scrap on the bed of the truck is required, the claw may damage the bed surface of the truck. It is, therefore, not possible to dredge the scrap satisfactorily.

(4) When grabbing the scrap on the bed of the truck is carried out, the scrap overflowed from between the claws may damage the side boards of the truck.

SUMMARY OF THE INVENTION

The present invention is made to overcome the problems as described in the foregoing. It is, therefore, an object of the present invention to offer a grab bucket for loading and unloading the scrap safely, accurately and quickly, as well as increasing the amount of the scrap to be loaded or unloaded in each operation. It is possible to perform loading and unloading the scrap on the corner of the bed of the truck without damaging the surface of the bed.

To achieve the above object, the grab bucket of the present invention comprises a plurality of pairs of grabbing claws opened and closed by means of hydraulic cylinders, said grabbing claws being perpendicularly hung and pivotably opened and closed at the upper portion of the claws around the main body suspended by a crane, an electromagnet movably supported between the opened grabbing claws from an ordinary location of the bottom surface of the main body to the downward dredging portion for the scrap and pairs of side claws provided at both side ends of the grabbing space surrounded by the plural numbers of pair of claws provided movably upward and downward.

Further, the plurality of pair of grabbing claws have tiptoe portions perpendicularly suspended when the claws are fully opened. The plural numbers of grabbing claws are closed by means of hydraulic synchronizing apparatus comprising a hydraulic cylinder of double cylinders type and manifold block.

In the foregoing composition, when the scraps to be grabbed are plentiful, the electromagnet is lifted up to the ordinary location under a bottom surface of the main body, and the scraps are held by the closing motion of the grabbing claws under the condition of the electromagnet being excited. By attraction of the electromagnet and holding with the grabbing claws, a considerably large amount of the scraps are safely and accurately loaded and unloaded. As the tiptoe portion of the grabbing claws are closed in vertically suspended state and the side board claws are also held perpendicularly, it is carried out easily to -take off the scrap from the corner of the bed of the truck.

It is possible to prevent the scrap from failing down on the way of delivery by surrounding the scrap with closed grabbing claws and descending side board claws, the scrap is also prevented from overflowing out of the grabbing claws, thus safety loading and unloading work is carried out. As scrap does not protrude from the interspace between the grabbing claws, the side boards of the bed of the truck are not damaged. It is also possible to decrease thrusting power of the grabbing claws by slightly lifting up the grabbing claws due to the counteraction by the side board claws. In the vicinity of the bottom plate, the side board claws work as a sustainer during the opening and closing motion of the grabbing claws, thus the bottom plate is prevented from being damaged by the closing claws.

It is also possible to prevent the scrap from overflowing by synchronizing the closing motion of the grabbing claws to increase grabbing efficiency.

As the amount of the scrap reduced and dredging work is required, the electromagnet is descended to the position under the grabbing claws to dredge the scrap. Unloading work is performed only by attraction of the electromagnet and no grabbing claw is used. Thus, it is possible to avoid damaging the bottom plate and the scrap is perfectly dredged from every corner of the bed of the truck. The same is said in the case of loading.

DETAILED DESCRIPTION OF THE PREFERRED EMBODIMENTS

Figure 1:
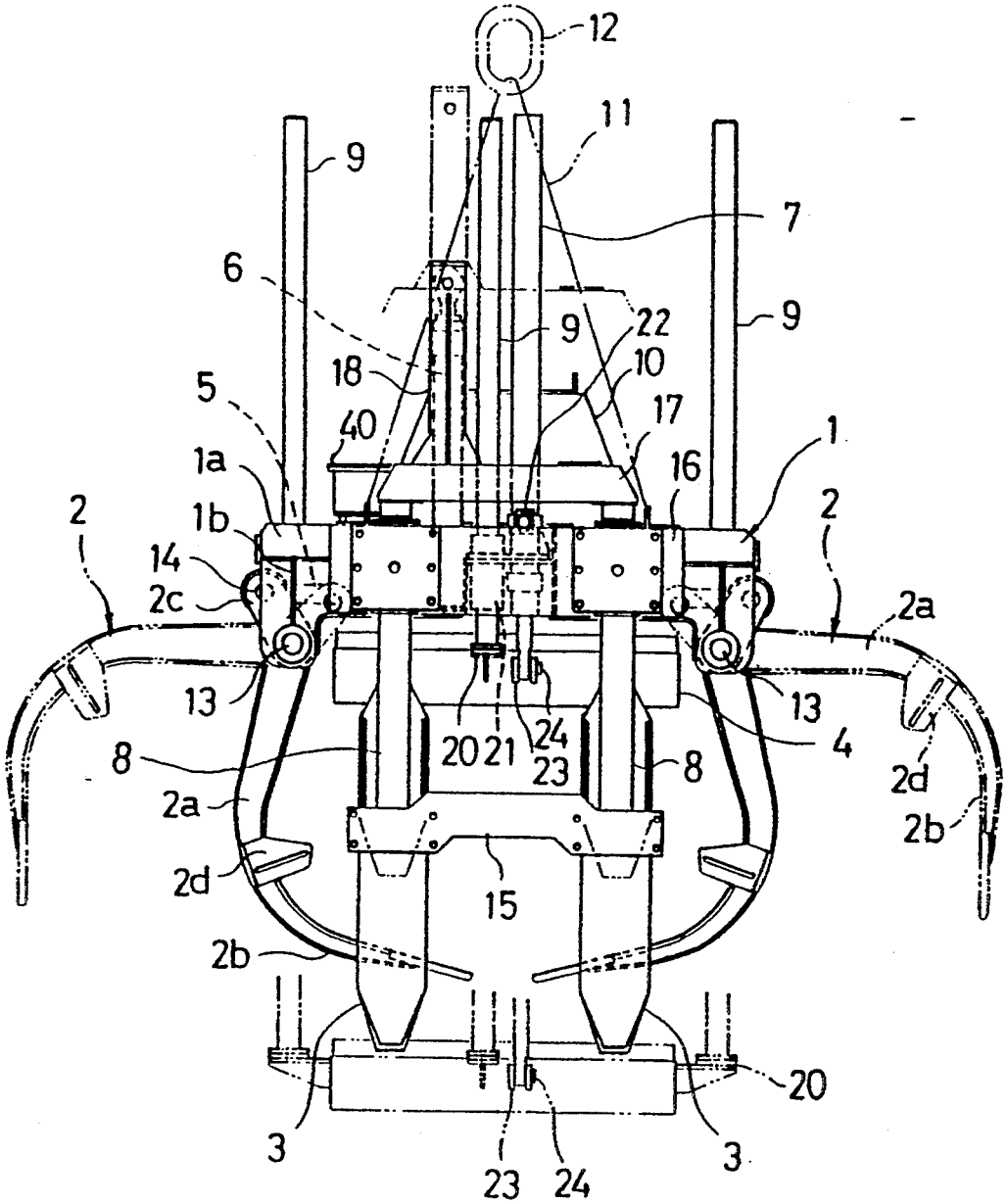
FIG. 1 is a side elevation of an embodiment of the grab bucket of the present invention.
Figure 2:
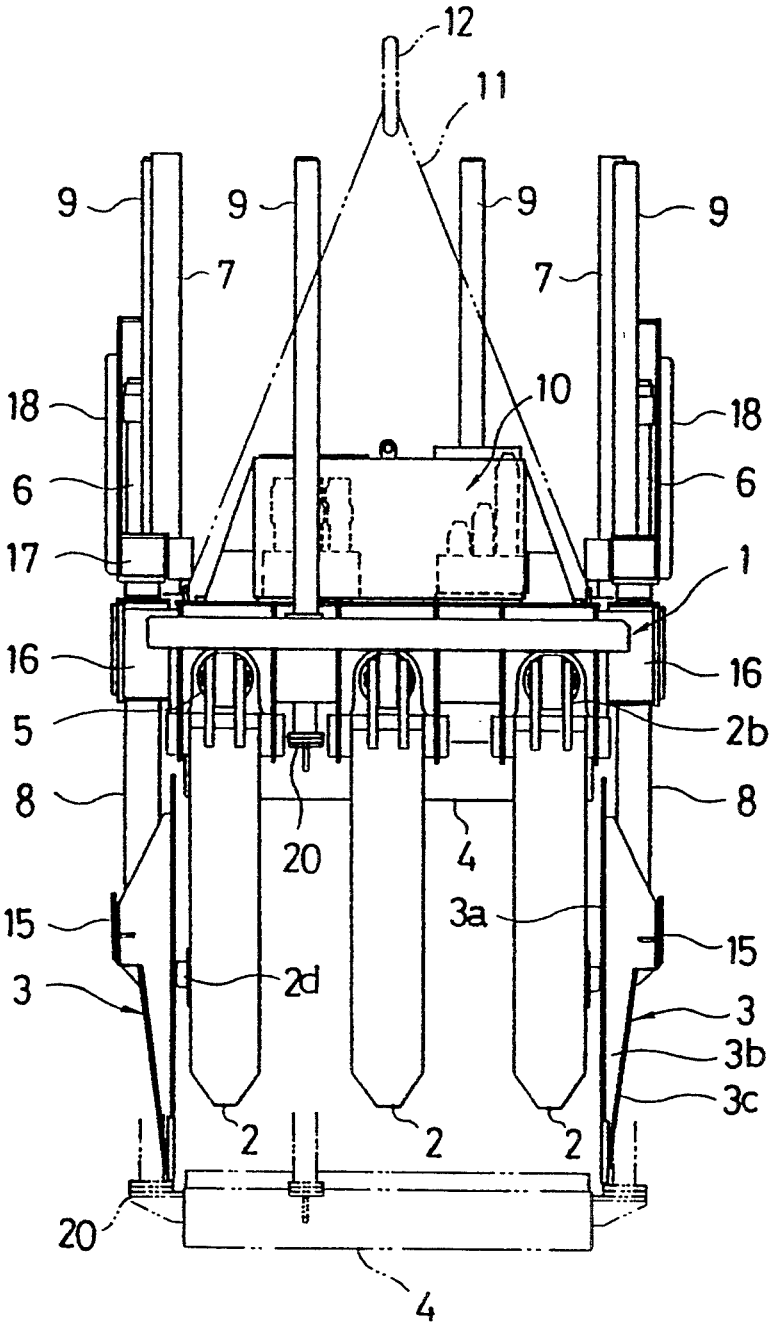
FIG. 2 is a front view of the grab bucket of FIG. 1.
Figure 3:
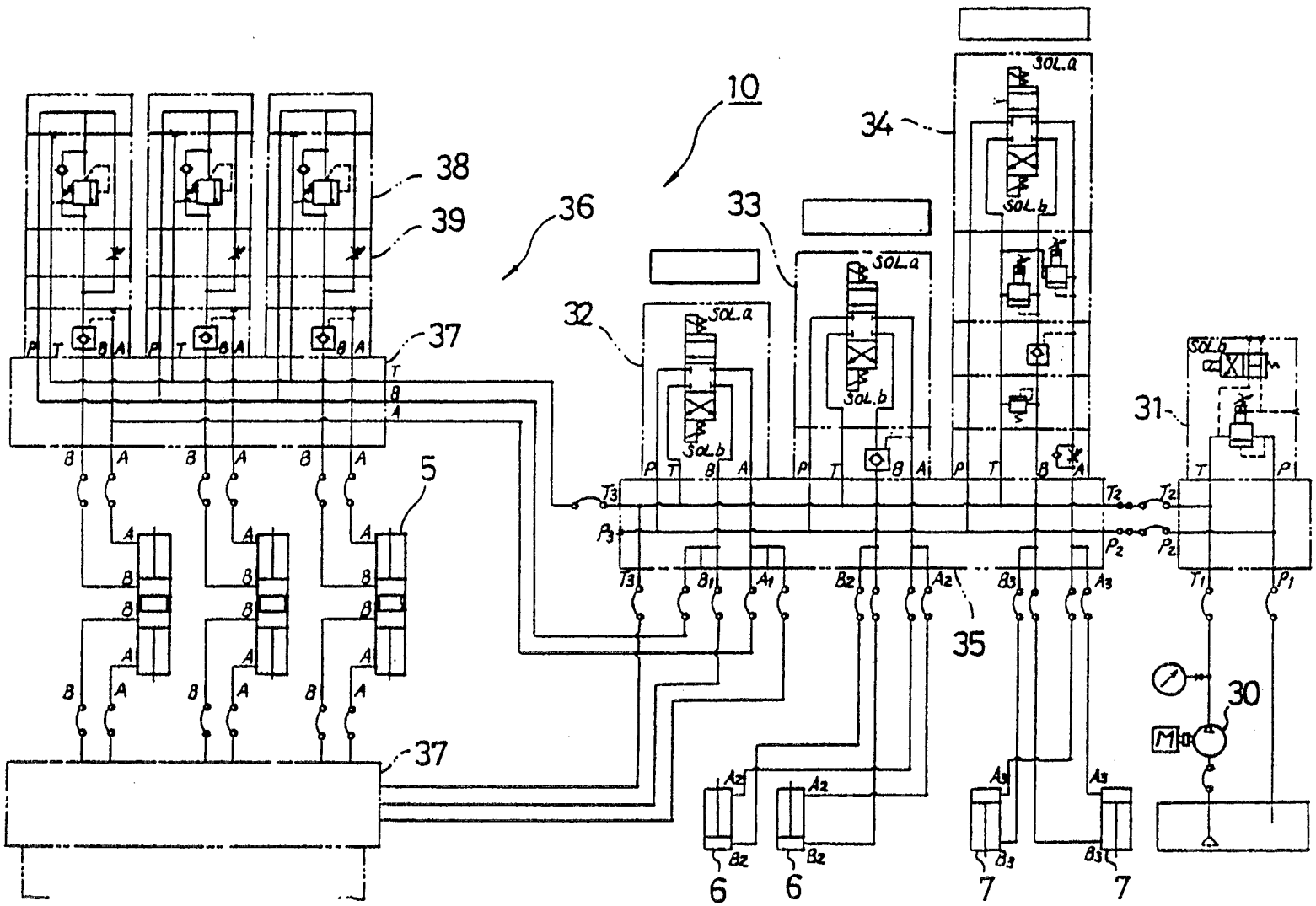
FIG. 3 is a diagram showing the hydraulic pressure system of the grab bucket of the present invention.

The following is an example of the grab bucket to load the scrap on and unload the same from for example the bed of a truck. FIG. 1 is a side elevation of the grab bucket. FIG. 2 is a front view of FIG. 1. FIG. 3 is a diagram of the hydraulic pressure system of the grab bucket of the present invention. As shown in FIG. 1 and FIG. 2, the grab bucket of the present invention comprises a girder main body 1, grabbing claws 2, side board claws 3, a lifting electromagnet 4, hydraulic cylinders 5 to open and close the grabbing claws, hydraulic cylinders 6 to lift and descend the side board claws, hydraulic cylinders 7 to lift and descend the electromagnet, guide rods 8 for the side board claws, guide rods 9 for the electromagnet and a hydraulic pressure equipment 10.

The girder main body 1 is a frame made of projecting parallels of plural numbers of supporting plates 1*a* and 1*b* and presents a rectangular pattern. The girder main body is suspended from the hook of a crane (not shown) with a lifting chain 11 and a ring 12.

A pair grabbing claws 2 is suspended facing each other. One side of the main body 1 of the grab bucket has three claws located with the same interval. Each of the three claws faces each of the three claws in the opposite side, respectively. The grabbing claws are rotatably supported with their upper edges mounted on the protruded portion of one end of the supporting plate la of the girder main body 1 with a main pin 13.

The two claws facing each other make one pair. The pair of the grabbing claws facing each other are opened and closed by the hydraulic cylinder 5. The hydraulic cylinder 5 is a type or double cylinders. Tip ends of the piston rods are connected to brackets 2*c* of the grabbing claws 2 with cylinder pins 14, respectively. The cylinders are mounted to the girder main body 1 movably up and down and as slanted by means of a trunnion shaft and upper and lower guide members (not shown) to absorb vertical and slant movement caused by forward and backward movement of the piston rod when the claws are opened and closed. The hydraulic cylinders 5 close the grabbing claws 2 three sets simultaneously by hydraulic synchronizing as described hereunder.

The grabbing claw 2 is composed of a main body 2*a* of an arc portion and a tiptoe portion 2*b* which is connected to the arc portion 2*a*. The tiptoe portion 2*b* is perpendicularly provided to the horizontal portion of said main body 2*a*. When the tiptoe portion 2*b* is fully opened, said tiptoe portion becomes almost perpendicular to the horizontal portion of the main body and when the tiptoe portion is fully closed, said tiptoe portion 2*b* becomes almost horizontal. There is provided a protruded frame 2*d* on each grabbing claw for preventing the scrap from being overflowed.

The side claws 3 are utilized to prevent the bucket from turning sideways when the bucket is landed. At first, the side claws are held as lifted so that the grabbing claws may hold the scrap sufficiently. The side claws come down grabbing of the scrap and the grabbing claws are closed to prevent the scrap from being overflowed. The two side claws are provided in each side; thus the total number of the side claws is four. The side claw 3 is mounted by means of a flat plate 3a of internal straight line and a slant plate 3*c* together with the flat plate 3*a*, the slant plate 3*c* being mounted to the flat plate 3*a* by means of a reinforcement rib 3*b*. The two side claws in each side are connected by means of a connection plate 15.

Further, a side claw guide rod 8 is protruded upwardly on the side claw. The guide rod 8 is supported movably upward and downward by a supporting member 16 and is moved by a lifting hydraulic cylinder 6. The upper ends of the pair of ]eft and right guide rods 8 are connected by means of a horizontal connecting member 17. The bottom end of the hydraulic cylinder 6 is fixed to a supporting member 16 with a cylinder bottom. The top end of the piston rod and the horizontal connecting member 17 are connected with a vertical connecting member 18. Such side claws 3 are located slightly above the tiptoe portion 2*b* of the grabbing claws 2 in the lifted condition. The bottom end of the side claw 3 in the descended condition is located underneath the tiptoe portion 2*b* of the grabbing claws in the closed condition.

The lifting electromagnet 4 is excited by an ON mark and excited by an OFF mark of the electric source. The lifting electromagnet 4 is supported to be movable upward and downward by means of electromagnet guide rod 9. It is moved up and down by the electromagnet lifting hydraulic cylinder 7. The electromagnet 4 is of rectangular pattern and slightly smaller than the girder main body 1. The electromagnet 4 is provided so as not to contact with the side claws 3 and the grabbing claws 2 when the grabbing claws are opened.

The guide rods 9 are vertically provided on every side of the electromagnet 4. The total number of the guide rods is four. The guide rod is provided between the neighboring grabbing claws or between the neighboring side claws so that the guide rod may not disturb lifting motion of the claws. The bottom portion of the guide rod 9 is connected to a connecting member 20 which is protruded at the side of the electromagnet 4. The intermediate portion of the guide rod is supported by a guide sleeve 21 provided at the side of the girder main body 1.

The two electromagnet lifting hydraulic cylinders 7 are provided in parallel with the guide rod 9 at the side claw 3 side and the cylinder body is mounted on the girder main body 1 through a pin 22. The tiptoe portion of the piston rod is connected to a bracket 23 and a pin 24.

The scope of the stroke or the hydraulic cylinder 7 for the electromagnet 4 extends from the underneath location of the girder in body 1 to the location further downwards from the bottom surface of the side claws 3 with its attracting surface.

As shown in FIG. 3, the hydraulic pressure equipment 10 is composed of a main hydraulic pump 30, a relief valve 31 with electromagnetic control valve, an electromagnetic control valve 32 for the grabbing claws, an electromagnetic control valve 33 for the side claws, an electromagnetic control valve 34 for the electromagnet, a manifold block 35 and a hydraulic synchronizing device 36 for the grabbing claws. A pump unit comprising a hydraulic pump 30 an electric motor, or the like is mounted in the crane. The hydraulic pressure equipment 10 and the pump unit located outside are connected through a hose reel. It is also possible to apply a hydraulic equipment housing and a pump unit therein.

Electromagnetic control valves 33 and 34 are connected to the lifting hydraulic cylinder 6 for the side claws and the hydraulic cylinder 7 for lifting the electromagnet, respectively. The side claws 3 and the electromagnet 4 move upwardly and downwardly by a controlling solenoid. A hydraulic synchronizing apparatus 36 is connected to the hydraulic cylinder 5 of double cylinders type and an electromagnetic control valve 32 for the grabbing claws. The manifold block 37 supplies oil to the three sets of hydraulic cylinders for opening and closing the grabbing claws, a sequential control valve 38 of internal pilot pressure type with a checking device of the predetermined pressure is set and a flow regulating valve 39 is provided in a by-pass supply line in the closed direction. There are provided two sets of the manifold block 37 connected to the cylinder of the hydraulic cylinders 5 of double cylinders type.

Pressurized oil for the closed direction is supplied to the three sets of hydraulic cylinders 5 simultaneously from the manifold block 37. In the case of bottom dredging wherein the amount of the scrap is reduced and pressure is low, and when the three sets of the hydraulic cylinders 5 for opening and closing the grabbing claws are operated to the closing direction, the oil flows through the flow regulation valve 39. When the load becomes large in each cylinder 5 and pressure of the sequential control valve 38 goes over the predetermined value, the sequential control valve 38 opens and each hydraulic cylinder operates respectively.

A terminal box 40 of the lifting electromagnet 4 is located on the girder main body 1. The sequential controller controls the electromagnetic control valve of each hydraulic cylinder 5, 6 and 7 and the lifting electromagnet 4.

With the above mentioned composition, the grab bucket of the present invention is operated in the following order when the scrap is unloaded from the bed of the truck.

(1) The grab bucket is hung down onto the bed of the truck where the scrap is placed. The claws of the grabbing claws 2 are opened, while the side claws 3 and the lifting electromagnet 4 are in lifting condition.

(2) The grab bucket is descended and the grabbing claws 2 and the side claws 3 are inserted into the scrap. At the same time the electromagnet 4 is excited simultaneously.

(3) The grabbing claws 2 are closed by means of the hydraulic cylinders 5 and at the same time the side claws 3 are descended.

Full amount of the scrap is held in a housing space surrounded by the grabbing claws and the side claws due to the attraction by the electromagnet 4 and holding with the grabbing claws. Thus, a large amount of the scrap is taken out. The side claws 3 prevent the scrap from the interspace between the claws. The side claws 3 also prevent the scrap from overflowing sideways when the grabbing claws 2 grasp the scrap. The side claws 3 do not damage the side plate of the bed of the truck with the scrap. The descended side claws 3 lift up the grab bucket itself due to reaction from the scrap and reduce intrusion by the grabbing claws 2 to help horizontal movement of the tiptoe portion proceed closing operation accurately.

The tiptoe portion **2*b* and the side claws 3 are suspended in a vertical position when the grabbing claws are in the opened condition. It is, therefore, easy to locate the grab bucket in the corner of the bed of the truck. Unloading the scrap from the corner of the bed of the truck is proceeded quickly. The three pairs of the grabbing claws 2 are synchronously closed and the scrap is prevented from overflowing. Particularly, when 70 or 80% of the scrap is already unloaded and the rest of the scrap is to be dredged, the operating efficiency is increased. When the grabbing claws 2 open and close in the vicinity of the bottom surface of the bed of the truck, the side claws 3 support the grab bucket and tiptoe portion 2*b* does not contact the bottom surface of the bed; thus, it is possible to avoid damaging the bottom surface of the bed by closing grabbing claws 2**.

(4) In case the dredging operation is further proceeded when the scrap on the surface of the bed is reduced, the electromagnet 4 is descended by the hydraulic cylinder 7 and the grabbing claws are closed. Only the electromagnet 4 is used for unloading. The electromagnet 4 is located underneath the grabbing claws 2 and the side claws 3; thus, the total area of the bottom portion of the grab bucket become attractive. The hydraulic cylinders work as a cushion when the electromagnet descends onto the surface of the bed; thus, the bed is not damaged when dredging operation is proceeded. Every corner of the bed of the truck is treated.

(5) Lift up the grab bucket and move it to the unloading position.

(6) Deexcite the electromagnet 4 and release the scrap. Repeat the steps as described in the foregoing.

Next, in the case of loading the scrap onto the bed of the truck, a large amount of the scrap is loaded by the grabbing claws 2 and the lifting electromagnet 4 as set forth in the foregoing unloading steps. The side claws 3 are descended, or necessary, to prevent the scrap from overflowing. Of course, it is possible to load the scrap only by the electromagnet 4.

The above mentioned example is the case of loading and unloading the scrap when the hydraulic cylinders 7 for moving the electromagnet upward and downward and the guide rods 9 for the electromagnet are protruded a considerable length. In the case that the whole girder body is kept low due to the limit or the height of the ceiling crane, the following replacements are recommended. In FIG. 1, known expandable multicylinders are recommended for lifting the electromagnet 4 in place of the electromagnet guide rods 9. Also, a small hydraulic driven winch is recommended for lifting the electromagnet 4 in place of the hydraulic cylinders 7. The electromagnet 4 is lifted by means or a chain or belt (lifting by electric drive and descending by gravity). In this composition the guide rods 9 are kept low about by half. It is of course possible to keep the main body low with any other means.

The foregoing explanation is set forth by way of example when the scrap is loaded and unloaded from and onto the bed of the truck. Various changes may be made without departing from the spirit and scope of the invention. For example, it is of course possible to apply the grab bucket of the present invention to load and unload the magnetic scrap into the housing space surrounded by fences.

ADVANTAGES OF THE PRESENT INVENTION

As described in the foregoing, the grab bucket of the present invention is composed of the grabbing claws provided for closing and opening around the circumference of the main body of the grab bucket and the electromagnet provided underneath the main body, the electromagnet being movable from the ordinary location underneath the main body down to the dredging location of the scrap. The side claws are vertically movable to prevent the scrap from overflowing. Further, the plural numbers of the pair of the grabbing claws are synchronously operated; thus, the following advantages are obtained.

(1) In case of an ordinary loading and unloading, a large amount of the scrap is treated at one time by means of magnetic attraction by the electromagnet and holding by the grabbing claws.

(2) The tiptoe portion of the grabbing claws and the side claws are suspended substantially perpendicular to the scrap surface; thus, it is easy to perform unloading the scrap from every corner of the bed of the truck.

(3) When the amount of the scrap is decreased, the electromagnet attracts the scrap; thus, the surface of the bed is not damaged and yet dredging operation is proceeded quickly.

(4) The side claws prevent the scrap from overflowing during loading and unloading. It is also possible to prevent the side boards from being damaged by the protruded fragments of the scrap. Further, the grab bucket is lifted when the grabbing claws are closed; thus, thrusting by the tiptoe of the grabbing claws is decreased. It is, therefore, possible to proceed closing and opening of the grabbing claws accurately. The side claws support the grabbing claws when the grabbing claws are opened and closed. Damaging of the surface of the bed is avoided.

(5) As all the grabbing claws are closed synchronously, overflowing of the scrap is prevented and grabbing efficiency is increased.

What is claimed is:

1. An electrohydraulic grab bucket with a lifting magnet and a main body adapted to be suspended by a crane with a suspending chain, said grab bucket retrieving magnetically attracted material disposed upon a surface, said bucket comprising:

at least one pair of grabbing claws rotatably supported on said main body and operable by hydraulic means for rotating said grabbing claws between an opened and closed position, said pair of grabbing claws defining opposite sides of a housing interspace adapted to receive said magnetically attracted material;

a magnetic means for magnetically attracting said material, said magnetic means being provided at an underside of said main body in a direction facing said surface and adapted to be moved from a raised position proximate said main body to a dredging position toward said surface; and at least one pair of side claws adapted to move in a linear direction toward said surface in a descended condition and away from said surface in an ascended condition, and defining opposed sides of said housing interspace, wherein said opposed sides are positioned transverse to said opposite sides, and wherein a bottom end of said at least one pair of side claws in the descended condition being located below said at least one pair of grabbing claws in the closed position.

2. The grab bucket according to claim 1, wherein said at least one pair of grabbing claws comprise a tiptoe portion which is vertically oriented in said open position, said at least one pair of side claws in the ascended condition being located above said tiptoe portion in the closed position.

3. The grab bucket according to claim 1, further comprising a synchronizing means for synchronously closing said at least one pair of grabbing claws.

4. The grab bucket according to claim 1, wherein said magnetic means comprises an attracting surface for attracting said magnetically attracted material, said attracting surface adapted to be located below said at least one pair of grabbing claws in the closed position and said side claws in the descended condition.

5. The grab bucket according to claim 4, wherein said attracting surface substantially extends between said at least one pair of grabbing claws to define a large surface area and thereby increase an attracting efficiency of said magnetic means.

* * * * *

UNITED STATES PATENT AND TRADEMARK OFFICE

CERTIFICATE OF CORRECTION

PATENT NO. : 5,411,304

DATED : May 2, 1995

INVENTOR(S) : MUTO, et al.

It is certified that error appears in the above-identified patent and that said Letters Patent is hereby corrected as shown below:

Title page, Item [73] Assignee, please add;

-- Fukushima Ltd., Fukushima, Japan--.

Signed and Sealed this

Second Day of July, 1996

*Attest:*

*Attesting Officer*

BRUCE LEHMAN

*Commissioner of Patents and Trademarks*